US009579613B2

(12) United States Patent
Fawcett et al.

(10) Patent No.: US 9,579,613 B2
(45) Date of Patent: Feb. 28, 2017

(54) FOAM-AT-A-DISTANCE SYSTEMS, FOAM GENERATORS AND REFILL UNITS

(71) Applicant: GOJO Industries, Inc., Akron, OH (US)

(72) Inventors: Jonathan E. Fawcett, Stow, OH (US); Nick E. Ciavarella, Seven Hills, OH (US); Daniel M. Willis, Clinton, OH (US); Cory J. Tederous, Stow, OH (US)

(73) Assignee: GOJO Industries, Inc., Akron, OH (US)

( * ) Notice: Subject to any disclaimer, the term of this patent is extended or adjusted under 35 U.S.C. 154(b) by 171 days.

(21) Appl. No.: 14/549,720

(22) Filed: Nov. 21, 2014

(65) Prior Publication Data

US 2015/0165392 A1 Jun. 18, 2015

Related U.S. Application Data

(60) Provisional application No. 61/916,706, filed on Dec. 16, 2013.

(51) Int. Cl.

| | |
|---|---|
| ***B01F 3/04*** | (2006.01) |
| ***B01F 5/00*** | (2006.01) |
| ***B01F 5/06*** | (2006.01) |
| ***A47K 5/14*** | (2006.01) |
| ***B05B 7/00*** | (2006.01) |

(Continued)

(52) U.S. Cl.

CPC ..... *B01F 3/04992* (2013.01); *A47K 5/14* (2013.01); *B01F 3/04446* (2013.01); *B01F 5/00* (2013.01); *B01F 5/06* (2013.01); *B01F 5/0602* (2013.01); *B05B 7/0043* (2013.01); *A47K 2005/1218* (2013.01); *B05B 7/0483* (2013.01); *B05B 7/0491* (2013.01)

(58) Field of Classification Search

CPC ..... B01F 3/04; B01F 3/04446; B01F 5/00; B01F 2005/0002; B01F 2005/0025; B01F 2005/0037; B01F 5/06; B01F 5/0602; B01F 5/0604; B01F 5/0608

USPC ..... 261/76, 72.1

See application file for complete search history.

(56) References Cited

U.S. PATENT DOCUMENTS

| | | | |
|---|---|---|---|
| 3,995,167 | A | 11/1976 | Kulig |
| 7,819,289 | B2 | 10/2010 | Willis |

(Continued)

FOREIGN PATENT DOCUMENTS

| | | | |
|---|---|---|---|
| WO | 2008049854 | A1 | 5/2008 |

OTHER PUBLICATIONS

International Search Report and Written Opinion from International Application No. PCT/US2014/067047 date of mailing Feb. 12, 2015.

(Continued)

*Primary Examiner* — Robert A Hopkins

(74) *Attorney, Agent, or Firm* — Calfee, Halter & Griswold LLP

(57) ABSTRACT

Exemplary foam-at-a-distance systems, refill units and foam generators are disclosed herein. An exemplary foam generator includes a body having an inlet for receiving air and an inlet for receiving liquid. The foam generator includes a plurality of baffles located within the body. A plurality of elongated spaces are formed at least in part by the baffles. The elongated spaces have a length that is greater than a width.

17 Claims, 8 Drawing Sheets

(51) Int. Cl.

| | |
|---|---|
| *B05B 7/04* | (2006.01) |
| *A47K 5/12* | (2006.01) |

(56) References Cited

U.S. PATENT DOCUMENTS

| | | | | |
|---|---|---|---|---|
| 8,348,105 | B2 * | 1/2013 | Wong | A47K 5/16 222/190 |
| 2005/0205600 | A1 | 9/2005 | Ophardt | |
| 2007/0278247 | A1 | 12/2007 | Banks | |
| 2008/0237266 | A1 | 10/2008 | Ciavarella et al. | |
| 2009/0277928 | A1 | 11/2009 | Bruckner | |
| 2012/0037657 | A1 | 2/2012 | Mazzotta | |
| 2013/0119083 | A1 | 5/2013 | Ophardt | |
| 2015/0216369 | A1 | 8/2015 | Hamilton | |
| 2015/0320266 | A1 | 11/2015 | Creaghan | |

OTHER PUBLICATIONS

Office Action from U.S. Appl. No. 14/717,429 dated Oct. 6, 2016.

* cited by examiner

FOAM-AT-A-DISTANCE SYSTEMS, FOAM GENERATORS AND REFILL UNITS

RELATED APPLICATIONS

This application claims priority to and the benefits of U.S. Provisional Patent Application Ser. No. 61/916,706 filed on Dec. 16, 2013 and entitled "FOAM-AT-A-DISTANCE SYSTEMS, FOAM GENERATORS AND REFILL UNITS," which is incorporated herein by reference in its entirety.

TECHNICAL FIELD

The present invention relates generally to foam-at-a-distance dispenser systems and more particularly to counter-mount foam-at-a-distance systems, foam generators and refill units.

BACKGROUND OF THE INVENTION

Liquid dispenser systems, such as liquid soap and sanitizer dispensers, provide a user with an amount of liquid upon actuation of the dispenser. Counter mount systems often have an air pump and a liquid pump located under the counter and an outlet nozzle located above the counter. Many systems create foam below the counter and push the foam up though a dispense tube to the outlet nozzle located at the end of a spout. Pushing foam up the dispense tube requires a significant amount of energy which drains batteries. In addition, residual foam may break down in the dispense tube and thus, the next dose of soap may contain liquid or a poor quality foam. One solution is to push liquid and air up separate tubes and mix the liquid and air near the end of the spout. U.S. Pat. No. 7,819,289, which is incorporated herein in its entirety, discloses separate air and liquid pumps feeding separate tubes to a foam at a distance nozzle. U.S. Pat. Publication 2008/02372266, which is also incorporated herein in its entirety, discloses a refill unit having a combined air and liquid pump that uses separate liquid and air tubes to feed liquid and air to a foam-at-a-distance nozzle. Current foam-at-a-distance nozzles or foam generators utilize a mixing chamber to combine liquid and air and one or more screens for creating turbulence that causes the mixture to form a foam. Fluid tends to dry and build up on the openings in the screens, causing current foam-at-a distance nozzles to clog.

SUMMARY

Exemplary foam-at-a-distance systems, refill units and foam generators are disclosed herein. An exemplary foam generator includes a body having an inlet for receiving air and an inlet for receiving liquid. The foam generator includes a plurality of baffles located within the body. A plurality of elongated spaces are formed by the baffles. The elongated spaces have a length that is greater than a width.

Another exemplary foam generator has a body that has an inlet for receiving air and an inlet for receiving liquid. At least three baffles are located within the body and are aligned with one another. In addition, a plurality of elongated spaces are formed by the elongated members.

Another exemplary foam generator has a body that has an inlet for receiving air and an inlet for receiving liquid. A plurality of elongated members are located within the body. In addition, a plurality of elongated spaces are formed at least in part by the elongated members, wherein the elongated spaces have a length that is greater than a width.

An exemplary refill unit for a foam-at-a-distance dispenser includes a liquid container, a liquid pump and an air pump. A liquid dispense tube having a first end in fluid communication with the liquid pump and a second end located a set distance from the liquid pump is included. In addition, an air dispense tube having a first end in fluid communication with the air pump and a second end located a set distance from the air pump is also included. The exemplary refill unit includes a foam generator having a body with an inlet connected to the second end of the liquid dispense tube and an air inlet connected to the second end of the air dispense tube. A plurality of baffles are located within the body, and a plurality of elongated spaces are formed by the elongated members.

An exemplary counter mount foam-at-a-distance system includes a liquid container, a liquid pump and a liquid dispense tube having a first end in fluid communication with the liquid pump and a second end located a set distance from the liquid pump. The exemplary system includes an air pump and an air dispense tube having a first end in fluid communication with the air pump and a second end located a set distance from the air pump. A foam generator having a body is also included in the system. The foam generator has a body having an inlet connected to the second end of the liquid dispense tube and an air inlet connected to the second end of the air dispense tube. A plurality of elongated members located within the body and a plurality of elongated spaces formed by the elongated members.

Another exemplary embodiment of a foam generator includes a body having an inlet and an outlet. A fluid passage is located between the inlet and the outlet. The inlet is configured to receive air from an air supply and liquid from a liquid supply. The body made of a first half and a second half. The first half and the second half are made of a molded plastic. At least one of the first half and the second half include a plurality of baffles. In addition, a plurality of elongated spaces are located between at least a portion of the plurality of baffles and the inside of the body when the first half and the second half are joined together. The plurality of baffles cause the fluid passage between the inlet and the outlet to be a tortuous path.

Yet another exemplar embodiment of a foam generator includes a body having an air inlet, a liquid inlet and a foam outlet. A plurality of baffles are located within the body forming a tortuous path from the inlet so the foam outlet.

In this way, a simple and economical systems, nozzles and refill units are provided.

BRIEF DESCRIPTION OF THE DRAWINGS

These and other features and advantages of the present invention will become better understood with regard to the following description and accompanying drawings in which.

DETAILED DESCRIPTION

Figure 1:
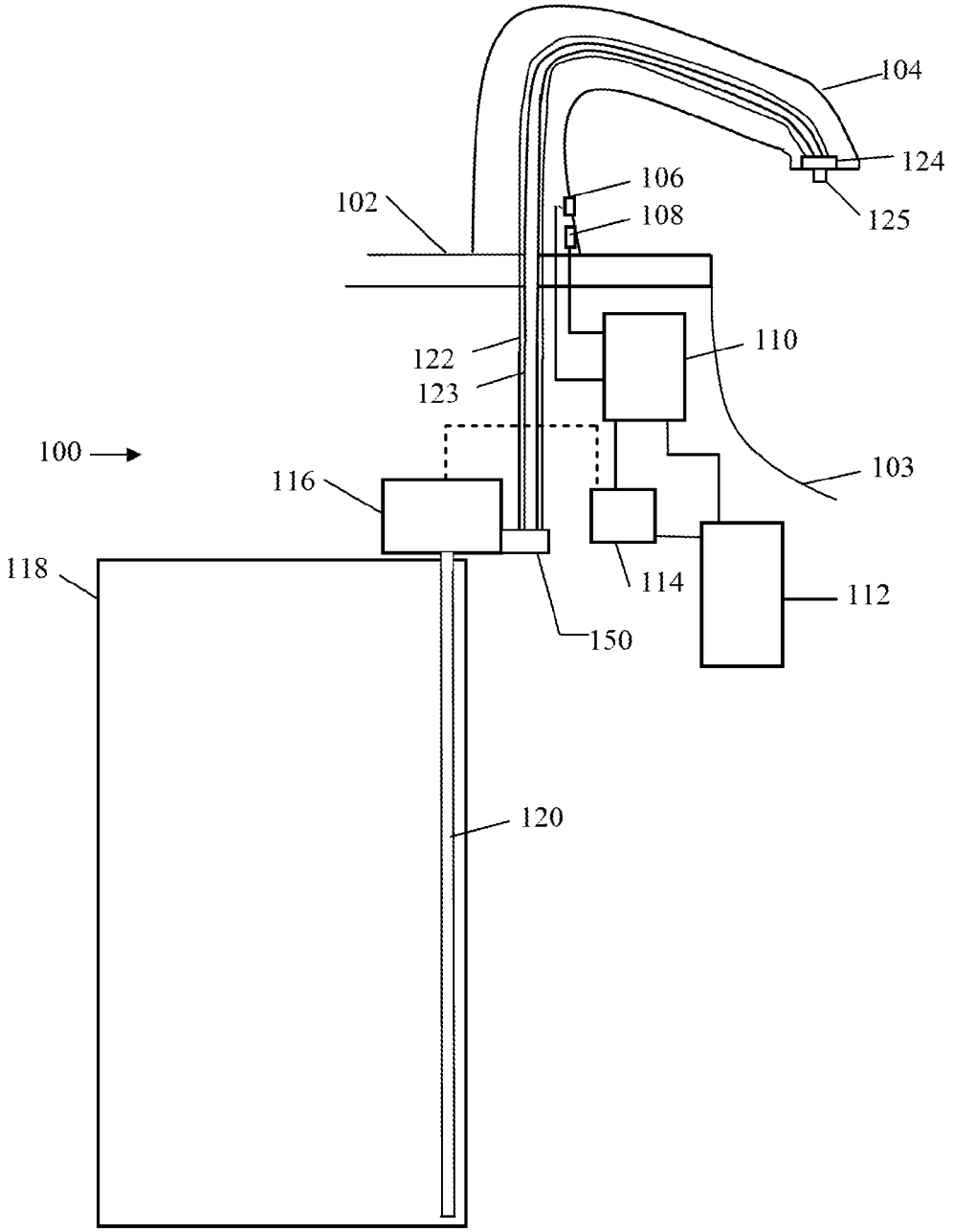
FIG. 1 is a schematic view of an exemplary embodiment of a foam-at-a-distance dispenser system.

FIG. 1 is a schematic view of an exemplary embodiment of a foam-at-a-distance dispenser system 100. Foam-at-a-distance dispenser system 100 includes a spout 104, which is mounted to a countertop 102. Spout 104 includes an object sensor 106, such as, for example, an infrared sensor, a motion sensor, a capacitance sensor or the like. Sensor 106 is in circuit communication with controller 110. Controller 110 may include a processor, a microprocessor or the like. Controller 110 also includes any necessary memory or circuitry required to perform the functions described herein. In addition, in some embodiments, spout 104 includes feedback indicator 108. Feedback indicator 108 may provide a visual and/or an audible feedback to a user. Exemplary visual feedback indicators maybe, for example, one or more light emitting diodes (LEDs). Controller 1110 is in circuit communication with sensor 106, indicator 108 and pump actuator 114. Pump actuator 114 may be, for example, a motor that rotates one or more gears to actuate foam-at-a-distance dispenser pump 116.

"Circuit communication" indicates a communicative relationship between devices. Direct electrical, electromagnetic and optical connections and indirect electrical, electromagnetic and optical connections are examples of circuit communication. Two devices are in circuit communication if a signal from one is received by the other, regardless of whether the signal is modified by some other device. For example, two devices separated by one or more of the following—amplifiers, filters, transformers, optoisolators, digital or analog buffers, analog integrators, other electronic circuitry, fiber optic transceivers or satellites—are in circuit communication if a signal from one is communicated to the other, even though the signal is modified by the intermediate device(s). As another example, an electromagnetic sensor is in circuit communication with a signal if it receives electromagnetic radiation from the signal. As a final example, two devices not directly connected to each other, but both capable of interfacing with a third device, such as, for example, a CPU, are in circuit communication.

A power source 112 provides power to the controller 110, pump actuator 114 and any other components that require power. Power supply 112 may be one or more batteries, or may be a hard wired power source and draw power, from for example, an 120 VAC line. In such case, power supply 112 may include any necessary transformers, rectifiers, or power conditioning devices to obtain suitable power for the components described herein. Pump actuator 114 actuates foam-at-a-distance pump 116.

Foam-at-a-distance pump 116 is connected to inlet dip tube 120, which is located in container 118, and liquid dispense tube 122 and air dispense tube 123 (which in some embodiments are coaxial) that extend up through spout 104 to foam generator 124, where the liquid and air are mixed together and dispensed through outlet 125. In some embodiments, container 118, foam pump 116, dip tube 120, outlet tubes 122, 123 and foam generator 124 form a refill and may be replaced when container 118 runs out of fluid or stops working. Container 118 contains a fluid, such as, for example, a foamable soap or sanitizer.

Controller 110 includes logic or circuitry for operating pump actuator 114 that operates pump 116 and the other electronic components identified above as required. "Logic" is synonymous with "circuit" or "circuitry" and includes, but is not limited to hardware, firmware, software and/or combinations of each to perform a function(s) or an action(s). For example, based on a desired application or needs, logic may include a software controlled microprocessor or microcontroller, discrete logic, such as an application specific integrated circuit (ASIC) or other programmed logic device. Logic may also be fully embodied as software. The circuits identified and described herein may have many different configurations to perform the desired functions.

Figure 2:
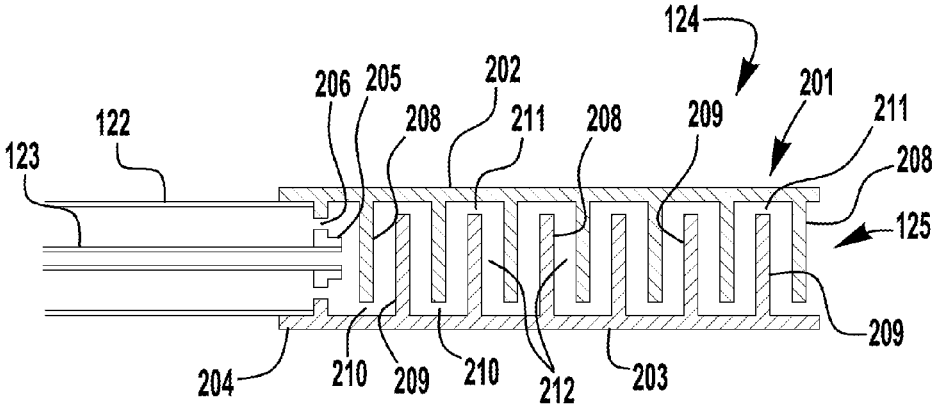
FIG. 2 is a cross-section of an exemplary foam generator.

FIG. 2 is a cross-section of an exemplary embodiment of foam generator 124. Foam generator 124 has a cylindrical housing 201. Cylindrical housing 201 is formed by a first half 202 and a second half 203 that when connected together form the cylindrical housing 201. First half 202 and second half 203 may be connected together by any type of connection, such as, for example, an adhesive connection, a welded connection, a snap-fit connection, or the like. In addition, first half 202 and second half 203 may be connected together by, for example, locking tabs (not shown). Cylindrical housing 201 includes an annular projection 204 for engaging air dispense tube 122. Air dispense tube 122 may be retained in annular projection 204 by any type of connection, such as, for example, a friction-fit connection, an adhesive connection, a barbed connection or the like. In addition, although the air dispense tube 122 is illustrated on the inside of annular projection 204, air dispense tube 122 may fit over annular projection 204.

Similarly, cylindrical housing 201 includes a second annular projection 205 for connection to liquid dispense tube 123. Liquid dispense tube 123 may be secured to annular projection 205 by any type of connection, such as, for example, the types of connections described above. A plurality of openings 206 are located in cylindrical housing 201 to allow passage of air from air dispense tube 122 into cylindrical housing 201.

First half 202 includes a plurality of baffles 208 and second half 203 includes a plurality of baffles 209. When first half 202 and second half 203 are connected together, there is a space 210 located between the end of baffles 208 and the semi cylindrical housing of second half 203. In addition, in some embodiments, there is a gap (not shown) between the sides of baffles 208 and the cylindrical housing of second half 203. In some embodiments, there is a gap (not shown) between the sides of baffles 208 and the cylindrical housing of first half 202. Similarly, when first half 202 and second half 203 are connected together, there is a space 211 located between the end of baffles 209 and the semi cylindrical housing of second half 201. In addition, in some embodiments, there is a gap (not shown) between the sides of baffles 209 and the cylindrical housing of second half 203. In some embodiments, there is a gap (not shown) between the sides of baffles 209 and the cylindrical housing of first half 202. In addition, there are spaces 212 located between adjacent baffles 208, 209.

In some embodiments, the width of gaps 210 and gaps 211 are between about 0.006 inches and 0.015 inches. The cross-sectional area of the gaps is accordingly, the length of the gap times the width of the gap. The length of the gaps may range from about 10 to about 50% of the interior circumference of the cylindrical housing 201. Accordingly, if the interior diameter of the cylindrical housing 201 is 0.25 inches, and the length of the gap is 50% of the interior circumference, the cross-sectional area may be between about 0.00236 square inches and about 0.00589 square inches. In contrast, in prior art foam generators that utilize screens, the width and depth of the openings in the screen are about 0.002 inches, and accordingly, the cross-sectional area is only about 0.000004 square inches. Thus, the cross-sectional area of the gaps 210, 211 are significantly higher than the cross-sectional area of the openings in the screens. Accordingly, soap or residual fluid is less likely to clog up the inventive foam generators disclosed herein.

In some embodiments, the space 212 between adjacent baffles 208, 209 may also be between about 0.006 inches and 0.015 inches. In some embodiments, the space 212 may be larger than the width of the gap 210, 211. In some embodiments, a larger space 212 creates additional turbulence for the soap and foam mixture as it progresses through foam generator 124.

Foam generator 124 has 13 baffles 208, 209. In some embodiments, foam generator 124 has fewer baffles 208, 209 and in some embodiment has more baffles 208, 209. In some embodiments, foam generator 124 has between about 4 and 10 baffles 208, 209 and in some embodiments, has less than about 8 baffles 208, 209. Although foam generator 124 is illustrated with liquid dispense tube 123 and air dispense tubes 122 arranged coaxial, liquid dispense tube 123 and air dispense tube 122 may be side by side with a modified air and liquid inlet, such as, for example, the connector illustrated in FIG. 3.

The foam generators disclosed herein may be made of molded plastic in two parts. The two parts may be readily joined to one another. In contrast, the prior art foam generators that include screens, the screens must be inserted into the foam generators and welded into place, which is labor intensive and/or time consuming.

During operation, air is forced under pressure through air dispense tube 122 and liquid is forced under pressure through liquid dispense tube 123. The air and liquid mix and are forced in a tortuous path around a plurality of baffles 208, 209. The turbulence caused by the tortuous path through which the mixture is forced to travel and from passing through the gaps 210, 211 and spaces 212 causes the mixture to form a rich foam which is dispensed through outlet 125.

Figure 3:
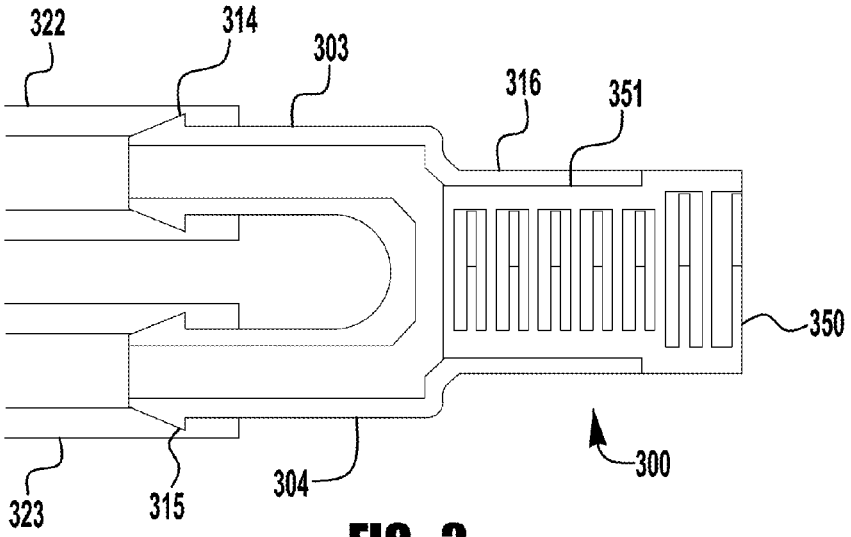
FIG. 3 is a cross-section of a connector and another exemplary foam generator.

FIG. 3 illustrates an exemplary connector 300 secured to a foam generator 350. Connector 300 includes a cylindrical housing 316 that slides over and secures to an outer cylindrical housing 351 of foam generator 350. In some embodiments, the cylindrical housing 316 secures to cylindrical housing 351 by a friction fit, an adhesive connection, a welded connection, a snap-fit connection or the like. In some embodiments foam generator 350 is fabricated in two pieces and cylindrical housing 316 serves as a connector to keep the two pieces connected to one another.

Connector 300 includes an annular projection 303 for engaging air dispense tube 322. Air dispense tube 322 is retained on annular projection 303 by a barb 314. However, any type of connection, such as, for example, a friction-fit connection, an adhesive connection, or the like, may be used. Similarly, cylindrical housing 316 includes a second annular projection 304 for connection to a liquid dispense tube 323. Liquid dispense tube 323 is secured to annular projection 304 by a barb 315, however, liquid dispense tube 323 may be secured to annular projection 304 by any type of connection. Although the illustrated exemplary embodiment has the air dispense tube 322 and liquid dispense tube 323 in a side-by-side configuration, other configurations may be used, such as, for example, a coaxial configuration. Foam generator 350 is generically illustrated and may be any of the foam generators described below.

Figure 4:
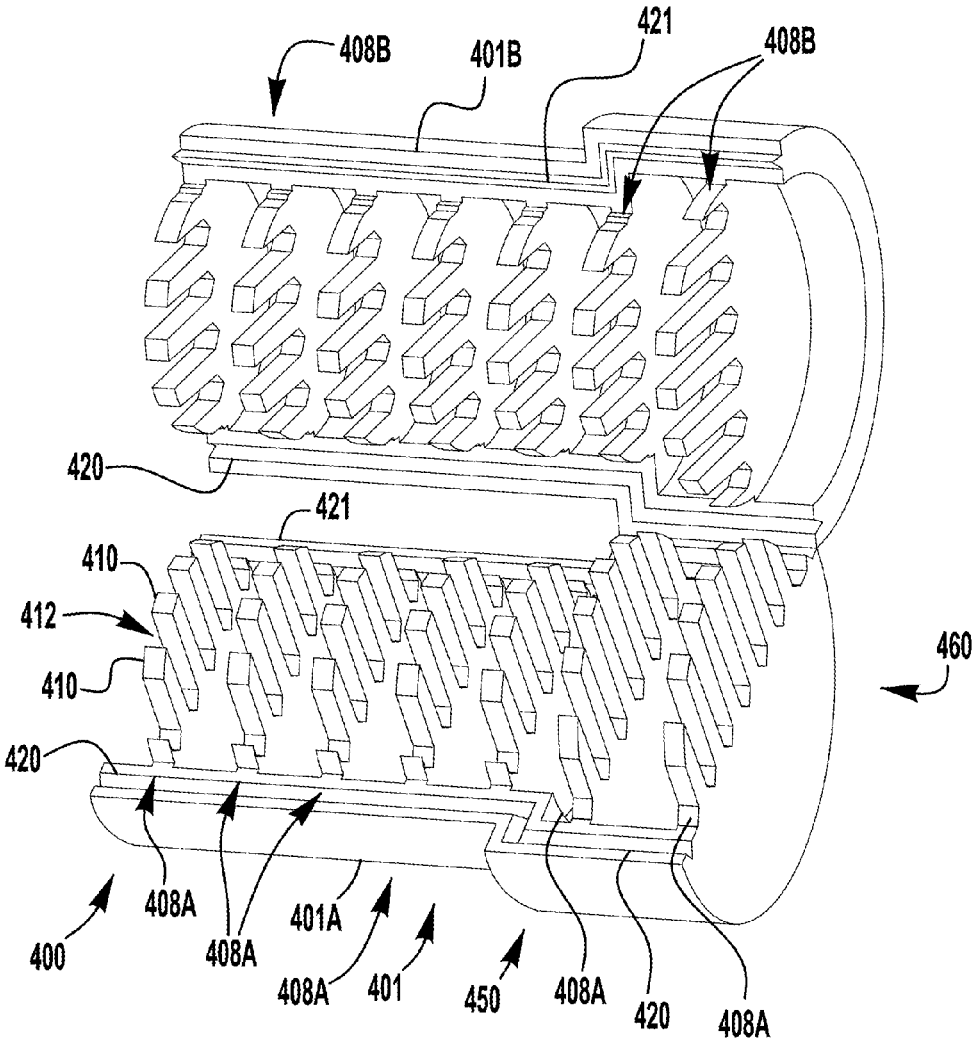
FIG. 4 is a prospective view of two halves of a foam generator.

FIG. 4 illustrates an exemplary foam generator 400. Foam generator 400 includes a cylindrical housing 401 formed by a first half 401A and a second half 401B that when connected together form the cylindrical housing 401. First half 401A and second half 401B contain a groove 420 and a tab 421. The tab 421 in first half 401A fits into groove 420 of second half 401B and tab 421 of second half 401B fits within groove 420 of first half 401A. First half 401A and second half 401B may be connected together by any type of connection, such as, for example, an adhesive connection, a welded connection, a snap-fit connection or the like. In addition, first half 401A and second half 401B) may be connected together by, for example, locking tabs (not shown).

First half 401A includes a plurality of baffles 408A having comb-like projections. The plurality of baffles 408A. Similarly, second half 401B includes a plurality of baffles 408B. Baffles 408A and 408B are offset so that when first half 401A and second halve 401B are connected together, baffles 408B fit between baffles 408A in an alternating sequence.

The exemplary embodiment illustrates 14 baffles 408A, 408B. Some embodiments contain more than about 14 baffles 408A, 408B and some embodiments contain less than about 14 baffles 408A, 408B. In some embodiments, there are between about 3 and about 10 baffles 408A, 408B. In some embodiments, there are between about 6 and about 8 baffles 408A, 408B. In some embodiments, the second half 401B of cylindrical housing 401 is a shell and does not contain any baffles.

The baffles 408A, 408B contain a plurality of projections 410 separated by gaps 412 located between the projections 410. In some embodiments, the projections 410 extend to about one-half of the depth of the baffles 408A, 408B. Accordingly, when the two halves 401A, 401B are connected together, gaps 412 on baffles 408A are across from a solid portion of an adjacent baffle.

In some embodiments, the width of gaps 412 are between about 0.006 inches and 0.015 inches. The cross-sectional area of the gaps is accordingly the length of the gap times the height of the baffle 408A, 408B. In the exemplary embodiment of FIG. 4, the gaps have substantially the same width along their entire length.

Foam generator 400 has a first cylindrical portion 401 and a second larger cylindrical portion 450. In some embodiments, one of the cylindrical portions is larger than the other. Second, larger cylindrical portion 450 increases the turbulence of the foamy mixture passing through. Although foam generators with two outside diameters are illustrated herein, foam generators with a single outside diameter and foam generators having multiple outside diameters are also contemplated herein.

In some embodiments, the space between adjacent baffles 408A, 408B may be between about 0.006 inches and 0.015 inches. In some embodiments, the space may be larger than the width of the gap 412. In the exemplary embodiment of FIG. 4, the input to foam generator 400 is a baffle 408A with projections 410 and the output of foam generator 400 is a baffle 408A with projections 410.

During operation, air is forced under pressure through air dispense tube 322 and liquid is forced under pressure through liquid dispense tube 323. The air and liquid mix and are forced between and/or through the plurality of baffles 408A, 408B. The turbulence caused by the tortuous path the mixture is forced to travel and from passing through the gaps 412 causes the mixture to form a rich foam which is dispensed through outlet 460.

In some of the embodiments disclosed herein, the number of baffles are identified, however, in practice, the number of baffles used or required will depend on many factors, such as, for example, the size of the foam generators, the formulations of the fluids being used, the viscosity of the fluids and the like. Accordingly, although the exemplary embodiments identify a certain numbers of baffles, each of the embodiments may be made with more or less baffles than are identified in a particular embodiment. At least about 3 baffles are generally required to produce foam. Preferably, 6 or more baffles are used. In some embodiments, between about 4 and about 16 baffles are used.

FIGS. 5-14 are prospective views of one-half of several embodiments of foam generators. The operation of all of the foam generators is similar to that described above. FIGS. 5-14 disclose various embodiments showing various components which may be combined to form additional embodiment of foam generators that fall within the scope of the present invention. In addition, many of the components in FIGS. 5-14 are similar to those described with respect to FIGS. 2-4 and are not re-described with each additional embodiment.

Figure 5:
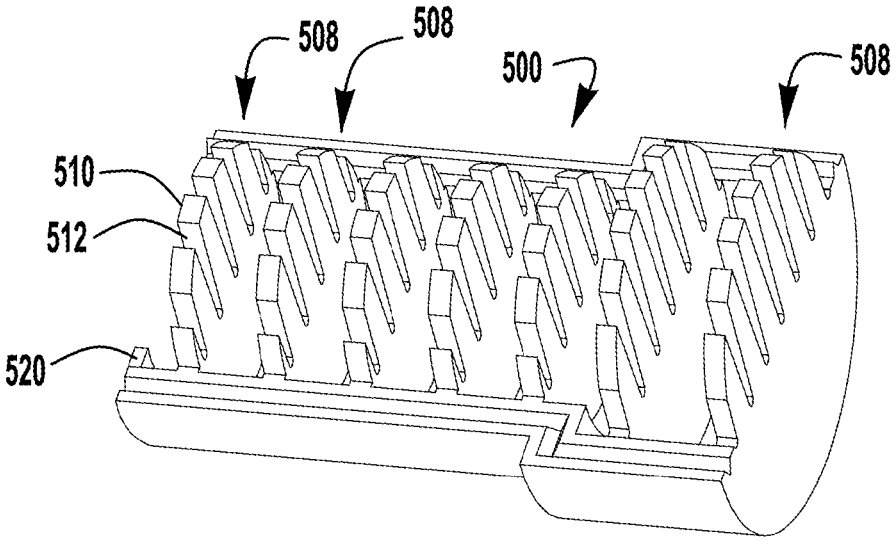
FIGS. 5-14 are prospective views of one half of additional foam generators.

FIG. 5 illustrates foam generator 500 which has a plurality of baffles 508. (As described above, FIG. 5 only illustrates one half of the foam generator 500 for purposes of clarity. The second half of foam generator 500 mates with the illustrated half as described above). Each of the baffles 508 include projections or fingers 510 with spaces 512 located between the projections fingers 510. Spaces 512 have a slight v-shape. In some embodiments, the spaces 512 extend about half way through baffles 508. In addition, in the exemplary embodiment of FIG. 5, the input of the foam generator 500 has an arcuate shaped baffle 520 and the output of foam generator 500 is a baffle 508 with projections 510. The exemplary foam generator 500 includes 13 baffles 508. In some exemplary embodiments, more than about 6 baffles 508 may be used.

Figure 6:
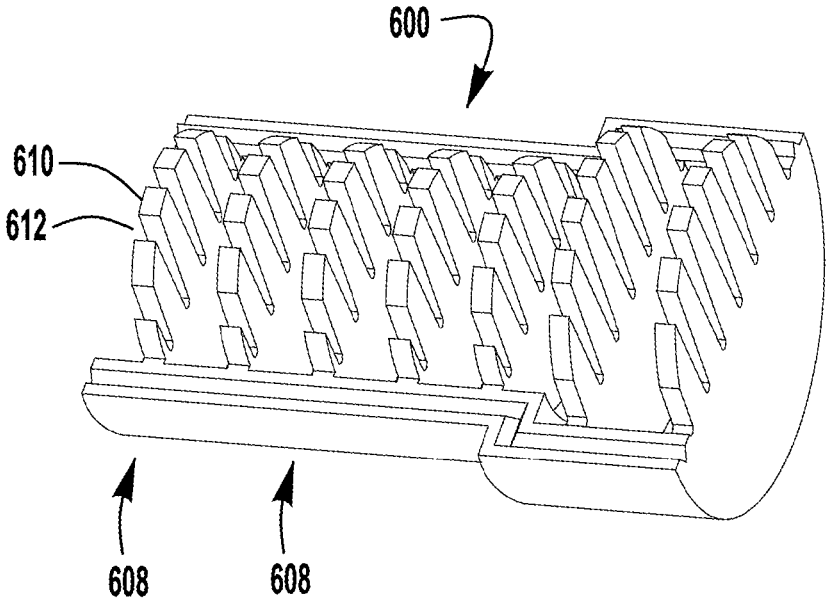

FIG. 6 illustrates foam generator 600 which has a plurality of baffles 608. (As described above, FIG. 6 only illustrates one half of the foam generator 600 for purposes of clarity. The second half of foam generator 600 mates with the illustrated half as described above). Each of the baffles 608 include projections or fingers 610 with spaces 612 located between the projections or fingers 610. Spaces 612 have a slight v-shape and extend about half way through baffles 608. In some exemplary embodiments, the spaces 612 extend more than half way through the baffles 608 and in some extend less than half way through the baffles 608. In the exemplary embodiment of FIG. 6, the input to foam generator 600 is a baffle 608 with projections 610 and the output of foam generator 600 is a baffle 608 with projections 610. The exemplary foam generator 600 includes 14 baffles 608. In some exemplary embodiments, more than about 6 baffles 608 are used.

Figure 7:
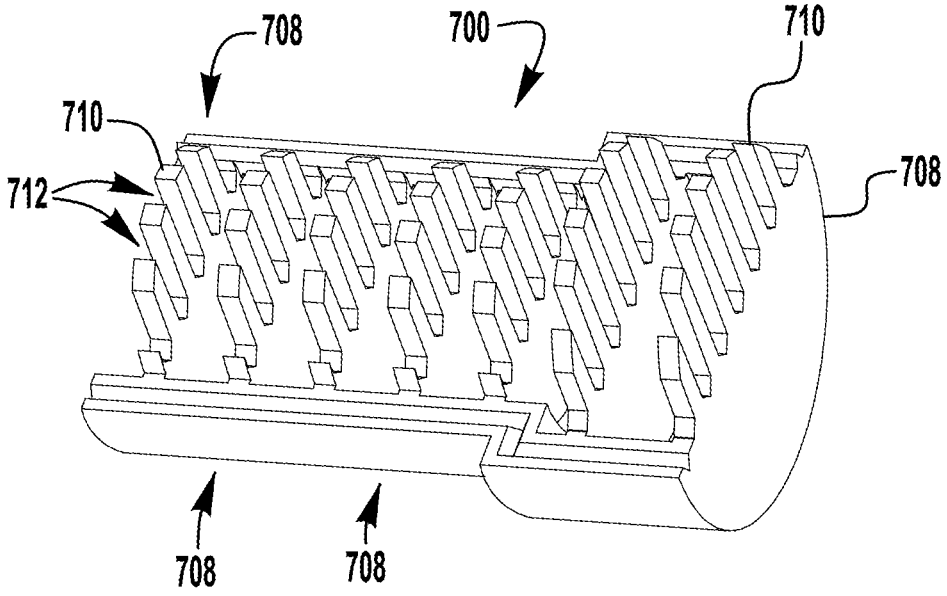

FIG. 7 illustrates foam generator 700 which has a plurality of baffles 708. (As described above, FIG. 7 only illustrates one half of the foam generator 700 for purposes of clarity. The second half of foam generator 700 mates with the illustrated half as described above). Each of the baffles 708 include projections or fingers 710 with spaces 712 located between the projections or fingers 710. Spaces 712 have a u-shape and extend about half way through baffles 608. In some exemplary embodiments, the spaces 712 extend more than half way through the baffles 708, and in some extend less than half way through the baffles 708. In the exemplary embodiment of FIG. 7, the input to foam generator 700 is a baffle 708 with projections 710 and the output of foam generator 700 is a baffle 708 with projections 710. The exemplary foam generator 700 includes 14 baffles 708. In some exemplary embodiments, more than about 6 baffles 708 are used, however, more or less may be used.

Figure 8:
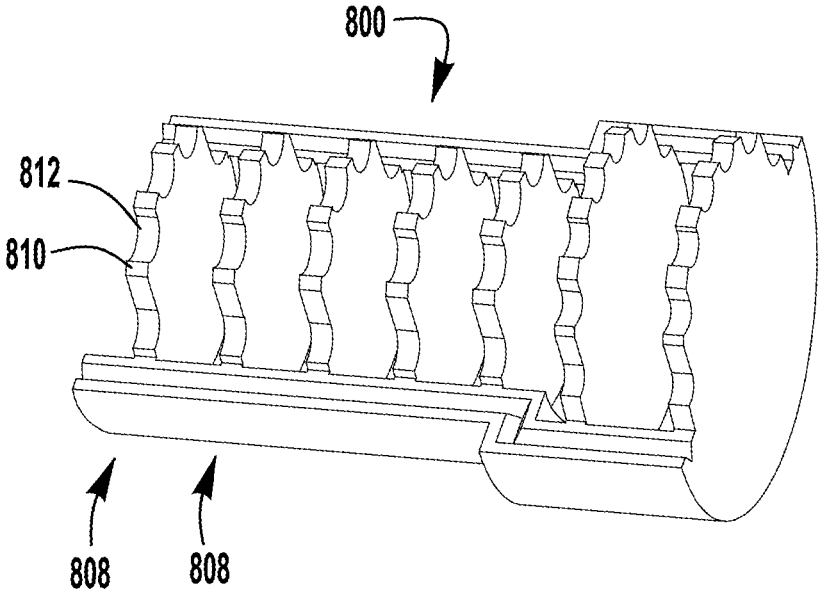

FIG. 8 illustrates another exemplary foam generator 800. (As described above, FIG. 8 only illustrates one half of the foam generator 800 for purposes of clarity. The second half of foam generator 800 mates with the illustrated half as described above). Foam generator 800 includes a plurality of baffles 808 (half of which are shown). Baffles 808 include projections 810 and spaces 812. Spaces 812 are semi-circular spaces. In the exemplary embodiment of FIG. 8, the input to foam generator 800 is a baffle 808 with projections 810 and the output of foam generator 800 is a baffle 808 with projections 810. The exemplary foam generator 800 includes 14 baffles 808.

Figure 9:
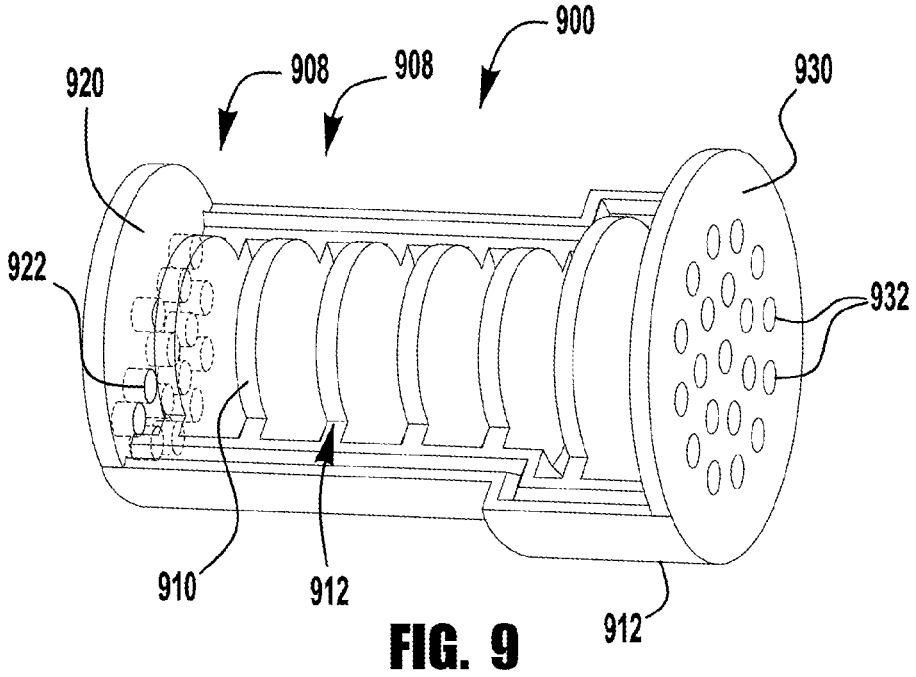

FIG. 9 illustrates another exemplary foam generator 900. (As described above, FIG. 9 only illustrates one half of the foam generator 900 for purposes of clarity. The second half of foam generator 900 mates with the illustrated half as described above). Foam generator 900 includes a plurality of baffles 908 (half of which are shown). Baffles 908 have a portion about the top half of the baffle 908 that is removed forming an arcuate top portion that is below the cylindrical body of the second half (not shown) of the foam generator 900 crating a passageway 912. In the exemplary embodiment of FIG. 9, the input to foam generator 900 is a baffle 920 with a plurality of openings 920 therethrough and the output of foam generator 900 is a baffle 930 with a plurality of apertures 932 therethrough. The exemplary foam generator 900 includes 12 baffles 908, baffle 922 and baffle 932.

Figure 10:
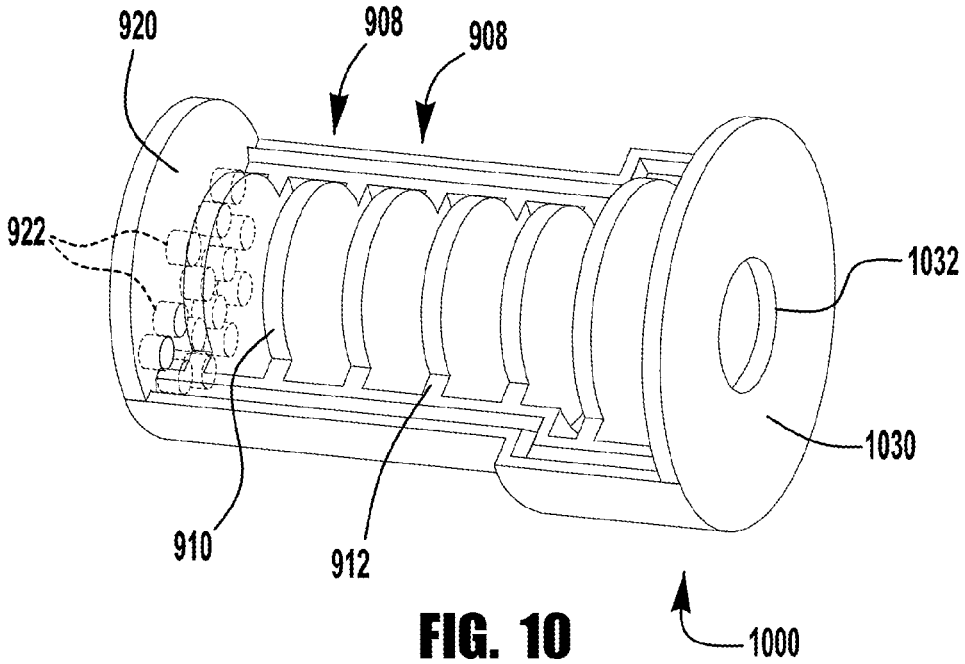
Figure 11:
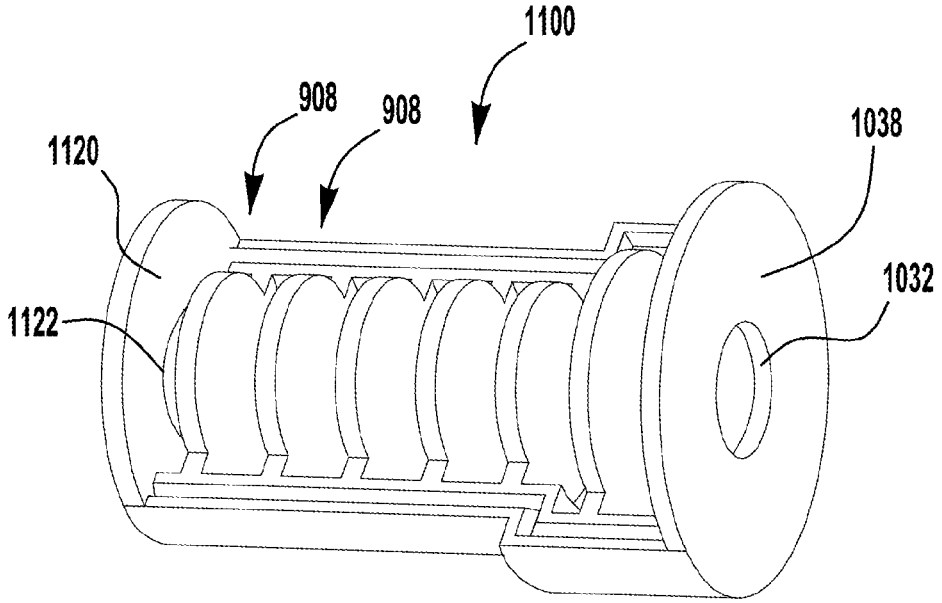

FIG. 10 illustrates another exemplary foam generator 1000. (As described above, FIG. 10 only illustrates one half of the foam generator 1000 for purposes of clarity. The second half of foam generator 1000 mates with the illustrated half as described above). Foam generator 1000 is substantially the same as foam generator 900 except, baffle 930 has been replaced with baffle 1030 which has a single aperture 1032 located therethrough. Similarly, FIG. 11 illustrates another exemplary foam generator 1100 that is substantially the same as foam generator 1000 except baffle 920 has been replaced by baffle 1120 which has a single aperture 1122 therethrough.

Figure 12:
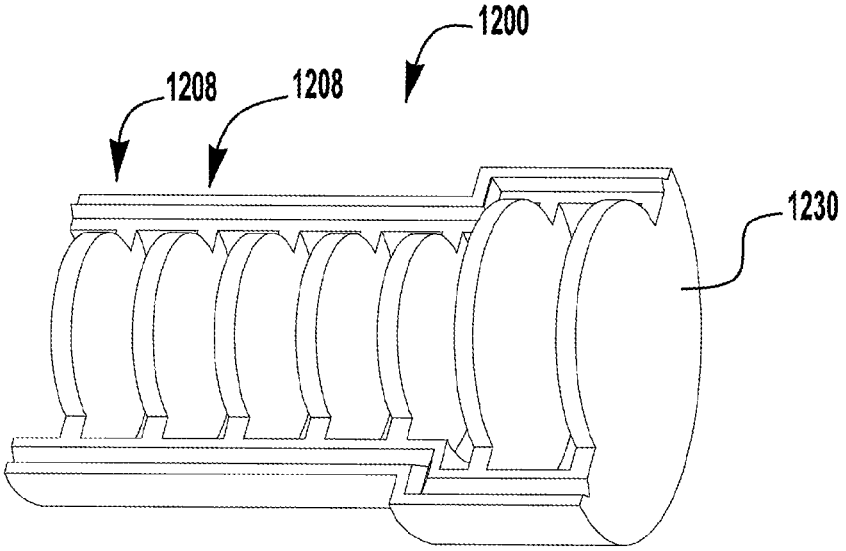

FIG. 12 illustrates another exemplary foam generator 1200. (As described above, FIG. 12 only illustrates one half of the foam generator 1200 for purposes of clarity. The second half of foam generator 1200 mates with the illustrated half as described above). Foam generator 1200 is substantially the same as foam generator 1100 except, baffle 1030 has been replaced with baffle 1230 which has a similar configuration to baffles 1208 creating a half-moon outlet.

Figure 13:
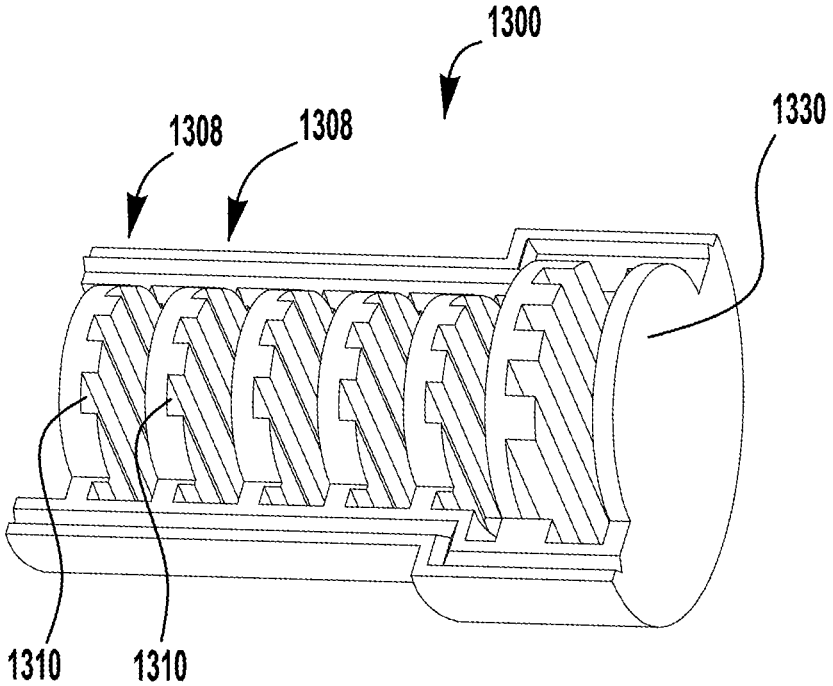

FIG. 13 illustrates another exemplary foam generator 1300. (As described above, FIG. 13 only illustrates one half of the foam generator 1300 for purposes of clarity. The second half of foam generator 1300 mates with the illustrated half as described above). Foam generator 1300 is similar to foam generator 1100. However, baffles 1308 include a plurality of channels 1301 which extend the length of the baffles 1308. In some embodiments, the baffles (not shown) of second half (not shown) of foam generator 1300 also have channels (not shown) facing the open channels 1310. In some embodiments, the channels (not shown) on the second half align with channels 1310. In some embodiments, the channels (not shown) are off-set from channels 1301. The channels 1301 provide narrow passages for the fluid to pass through. Baffle 1330 provides a half-moon shaped outlet.

Figure 14:
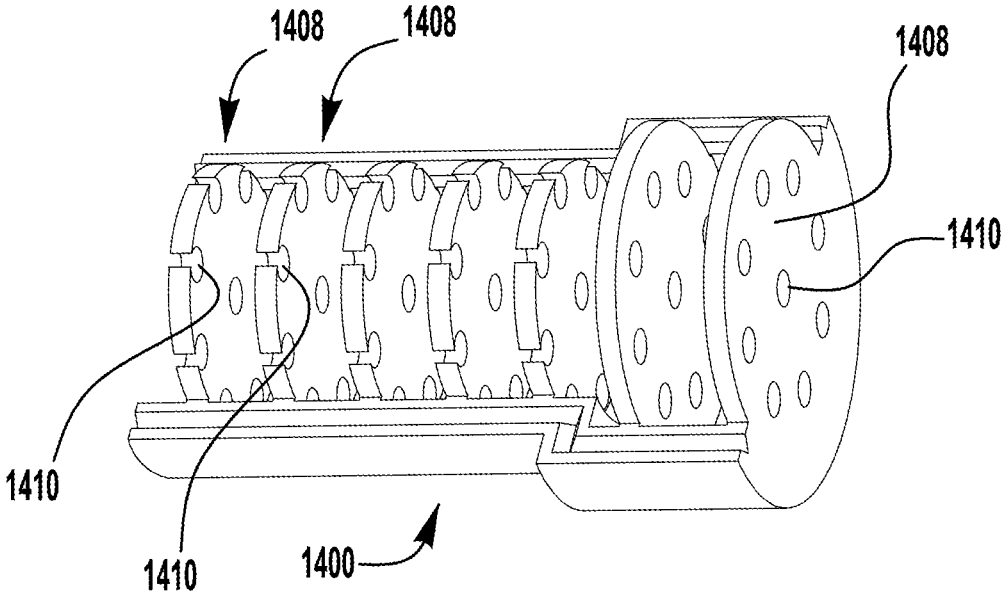

FIG. 14 illustrates another exemplary foam generator 1400. (As described above, FIG. 14 only illustrates one half of the foam generator 1400 for purposes of clarity. The second half of foam generator 1400 mates with the illustrated half as described above). Foam generator 1400 includes a plurality of baffles 1408. Baffles 1408 include a plurality of apertures 1410 located therethrough. The second half (not shown) of foam generator 1400 includes baffles (not shown) that are positioned between the baffles 1408 when the two halves are joined together. The baffles (not shown) on the second half (not shown) also contain a plurality of apertures.

Although many of the embodiments illustrated herein contain a single type of baffle, different types of baffles may be combined in a foam generator. For example, a foam generator could include the baffles 1208 shown and described with respect to FIG. 12 and the baffles 1408 shown and described with respect to FIG. 14. In one exemplary embodiment, a first half of the foam generator includes baffles 1208 and the second half of the foam generator includes baffles 1408. Any of the components shown and described with one embodiment may be combined with components of one or more other embodiments, without departing from the inventive concepts disclosed herein.

In some of the embodiments described herein, there are between about 2 and 10 pairs of baffles. A pair of baffles as used herein refers to an upper baffle and a lower baffle. In some embodiments, the diameter of the outside diameter of the foam generators is between about 0.15" and about 1." In some embodiments, the gaps between projecting members, or between the baffles and the housing are between about 0.005" and 0.5."

Although, the embodiments described herein mix air and a liquid, in some embodiments, the two liquids or more liquids are mixed together to form a foam as the two or more liquids pass through the foam generator.

While the present invention has been illustrated by the description of embodiments thereof and while the embodiments have been described in considerable detail, it is not the intention of the applicant to restrict or in any way limit the scope of the appended claims to such detail. Additional advantages and modifications will readily appear to those skilled in the art. Therefore, the invention, in its broader aspects, is not limited to the specific details, the representative apparatus and illustrative examples shown and described. Accordingly, departures may be made from such details without departing from the spirit or scope of the applicant's general inventive concept.

We claim:

1. A foam generator comprising:

An elongated cylindrical body having an inlet located at a proximal end and an outlet located at a distal end;

a fluid passage between the inlet and the outlet;

the inlet configured to receive air from an air supply and liquid from a liquid supply;

the body made of a first half and a second half;

the first half and the second half made of a molded plastic;

at least one of the first half and the second half including a plurality of baffles;

a plurality of elongated spaces located between at least a portion of the plurality of baffles and the inside of the body when the first half and the second half are joined together;

wherein the plurality of baffles cause the fluid passage between the inlet and the outlet to be a tortuous path.

2. The foam generator of claim 1 wherein the first half of the body includes a plurality of baffles and the second half of the body includes a plurality of baffles.

3. The foam generator of claim 2 wherein the plurality of baffles on the first half of the body have the same shape as the plurality of baffles on the second half of the body.

4. The foam generator of claim 1 wherein two or more of the plurality of baffles have different shapes.

5. A foam generator comprising:

an elongated cylindrical body;

the body having an inlet for receiving air located on a proximal end;

the body having an inlet for receiving liquid located on the proximal end;

a plurality of elongated members located within the elongated cylindrical body;

a plurality of elongated spaces formed at least partially by the elongated members;

the elongated spaces having a length that is greater than a width; and the elongated cylindrical body having an outlet at the proximal end, wherein the plurality of elongated members are located between the proximal end and the distal end;

wherein the elongated spaces in the two or more rows are aligned with one another; and wherein the elongated spaces in the two or more rows are off-set from one another.

6. The foam generator of claim 5 wherein at least three elongated members are aligned in a row traverse the flow of fluid past the elongated members and at least two elongated spaces are formed between the at least three elongated members, wherein the flow path through the elongated spaces are in parallel.

7. The foam generator of claim 5 wherein the elongated spaces in the two or more rows are aligned with one another.

8. The foam generator of claim 5 wherein the length of the elongated spaces are at least two times the width of the elongated spaces.

9. The foam generator of claim 5 wherein the length of the elongated spaces are at least three times the width of the elongated spaces.

10. A foam generator comprising:

an elongated cylindrical body;

the body having an inlet for receiving air located on a proximal end;

the body having an inlet for receiving liquid located on the proximal end;

a plurality of elongated members located within the elongated cylindrical body;

a plurality of elongated spaces formed at least partially by the elongated members;

the elongated spaces having a length that is greater than a width; and the elongated cylindrical body having an outlet at the proximal end, wherein the plurality of elongated members are located between the proximal end and the distal end;

wherein the elongated spaces are located between the body and the elongated members.

11. The foam generator of claim 10 wherein the elongated members extend substantially across the width of the body.

12. A foam generator comprising:

a body;

the body having an inlet for receiving air;

the body having an inlet for receiving liquid;

a plurality of elongated members located within the body;

a plurality of elongated spaces formed at least partially by the elongated members;

the elongated spaces having a length that is greater than a width; and the liquid inlet and the air inlet are coaxial.

13. A refill unit for a foam-at-a-distance dispenser-comprising:

a liquid container;

a liquid pump;

a liquid dispense tube having a first end in fluid communication with the liquid pump and a second end located a set distance from the liquid pump;

an air pump;

an air dispense tube having a first end in fluid communication with the air pump and a second end located a set distance from the air pump;

a foam generator having a body;

the body having an inlet connected to the second end of the liquid dispense tube;

the body having an air inlet connected to the second end of the air dispense tube;

a plurality of baffles located within the body; and a plurality of elongated spaces formed by the baffles; and wherein the elongated spaces are located between the body and the elongated members.

14. The refill unit of claim 13 wherein the elongated spaces in the two or more rows are off-set from one another.

15. The refill unit of claim 13 wherein the length of the elongated spaces are at least three times the width of the elongated spaces.

16. The refill unit of claim 13 wherein the length of the elongated spaces are at least four times the width of the elongated spaces.

17. The refill unit of claim 13 wherein the length of the elongated spaces are at least five times the width of the elongated spaces.

* * * * *